US007272952B2

(12) United States Patent
Beaudry

(10) Patent No.: US 7,272,952 B2
(45) Date of Patent: Sep. 25, 2007

(54) BEVERAGE-COOLING VESSEL

(75) Inventor: Robert Beaudry, Tucson, AZ (US)

(73) Assignee: Beaudry, Robert M., Trustee of the Beaudry Revocable Trust, Tucson, AZ (US)

( * ) Notice: Subject to any disclaimer, the term of this patent is extended or adjusted under 35 U.S.C. 154(b) by 454 days.

(21) Appl. No.: 10/869,323

(22) Filed: Jun. 15, 2004

(65) Prior Publication Data

US 2005/0274137 A1 Dec. 15, 2005

(51) Int. Cl.
*F25D 3/08* (2006.01)

(52) U.S. Cl. ..... 62/457.3

(58) Field of Classification Search ..... 62/371, 62/457.3, 457.4

See application file for complete search history.

(56) References Cited

U.S. PATENT DOCUMENTS 4,570,454 A * 2/1986 Campbell ..... 62/457.3
5,189,892 A * 3/1993 Roberts ..... 62/372
RE37,213 E 6/2001 Staggs
6,474,096 B1 * 11/2002 de la Guardia ..... 62/457.3
2003/0070446 A1 4/2003 Scullion et al.
2003/0161925 A1 8/2003 Scullion et al.
2003/0161931 A1 8/2003 Scullion et al.

FOREIGN PATENT DOCUMENTS

GB 2368113 4/2002

OTHER PUBLICATIONS

UK: New Technology . . . "Frozen crystals give drinkers an alternative pint of lager top", Financial Times Journal, Sep. 4, 2000, p. 4, London Edition 2.

* cited by examiner

*Primary Examiner*—Melvin Jones
(74) *Attorney, Agent, or Firm*—Ingrassia, Fisher & Lorenz, P.C.; Sean D. Johnson

(57) ABSTRACT

An apparatus and method for cooling a beverage, through the special design of a vessel for dispensing a beverage, is disclosed. The beverage is cooled while it is inside an upper portion of the vessel, through contact with a consumable substance with a lower temperature than the beverage. The consumable substance is located in a freezable reservoir, and is substantially frozen before the beverage is introduced into the vessel. The beverage and the consumable substance make contact through a neck separating the upper portion of the vessel from the freezable reservoir. As the consumable substance melts, it gradually mixes with the beverage, continuing to cool the beverage over a period of time, without ice floating to the top of the vessel.

22 Claims, 2 Drawing Sheets

BEVERAGE-COOLING VESSEL

FIELD OF THE INVENTION

The present invention relates generally to an apparatus and method for cooling a beverage, and more specifically to an apparatus and method which cools a beverage even as the beverage is served or consumed, without having ice float to the top of the vessel while the beverage is being served or consumed.

BACKGROUND OF THE INVENTION

There are a number of existing methods for keeping a beverage cold, with each method containing its own imperfection(s). One can refrigerate a beverage, but the beverage will begin to rise in temperature as soon as it is removed from the refrigerator. One can also use ice cubes, but these can melt quickly into the beverage and dilute the beverage, and can be bothersome to individuals when consuming the beverage.

One apparatus and method in the art is capable of cooling the beverage through the use of a vessel containing a motor, cooling coils and spray nozzles. However, that method increases the costs of manufacture of the vessel. That method also increases the difficulty and cost of using the vessel, requiring the use of technological components which require time and skill to use, and which are likely to break down over time. The cost and difficulty of use of that method are compounded by the likelihood that the coils, motor and spray nozzles will require maintenance and/or replacement over time.

Another apparatus and method in the art is capable of cooling a beverage through the use of an ultrasound emitter and a series of pumps and pipes to create a beverage with a dissolved gas content. However, this method also significantly increases the costs associated with manufacturing the vessel. The vessel in that method, with the complicated components, is also significantly more difficult and costly to use, and to maintain, compared with a typical vessel for drinking or serving a beverage.

Thus, a need exists for an apparatus and method, capable of being manufactured, used and maintained easily and economically, which cools a beverage even as the beverage is served or consumed, without having ice float to the top of the vessel while the beverage is being served or consumed.

SUMMARY OF THE INVENTION

The present invention provides a novel apparatus and method for cooling a beverage. The invention provides a system of cooling a beverage inside a vessel, without ice floating to the top of the vessel, and without the need for any motors or other mechanical parts.

The invention allows a beverage inside a vessel to be cooled through contact with a substantially frozen consumable substance separated by a neck in the vessel. The consumable substance, contained in a freezable reservoir of the vessel, gradually cools the beverage in the vessel as the consumable substance comes into contact with the beverage located on the other side of the neck of the vessel. As the consumable substance melts, it mixes with the beverage above, continuing to cool the beverage over a period of time without ice floating to the top.

The disclosed vessels and methods can take a number of different forms, with accompanying functional and/or aesthetic benefits. For example, the vessel can be, among various other possible embodiments, a mug, glass, pitcher, can or bowl. The component parts of the vessel can be configured so as to allow the beverage to be cooled more quickly or over a longer a period of time, or can be otherwise customized to meet the particular functional or aesthetic needs of particular customers. Some embodiments of the vessel have a freezable portion that is permanently attached to the portion of the vessel containing the beverage, while other embodiments contain separable parts, among other variations.

Similarly, the methods of manufacture can be tailored to the specific needs of the customer, or of the manufacturer, in terms of the materials and steps employed and the effect on cost and manufacture and the physical appearance, feel, and composition of the resulting end-product.

Other independent features and advantages of the invention will become apparent from the following detailed description, taken in conjunction with the accompanying drawings which illustrate, by way of example, the principles of the invention.

DETAILED DESCRIPTION OF THE DRAWINGS

A novel vessel and method for cooling a beverage is disclosed. The vessel contains a freezable portion with a bottom surface and a reservoir capable of holding a consumable substance, which in turn is capable of cooling a beverage in the upper portion of the vessel. The inventive design provides a cost effective, user-friendly means of cooling a beverage without ice floating to the top of the vessel. Unlike the existing prior art, the inventive design does require any motors, coils, spray nozzles, pumps, pipes or ultrasound emitters. Rather, the inventive design is inexpensive to produce, requires little in maintenance, and is easy for any purveyor or customer to use and maintain.

Figure 1:
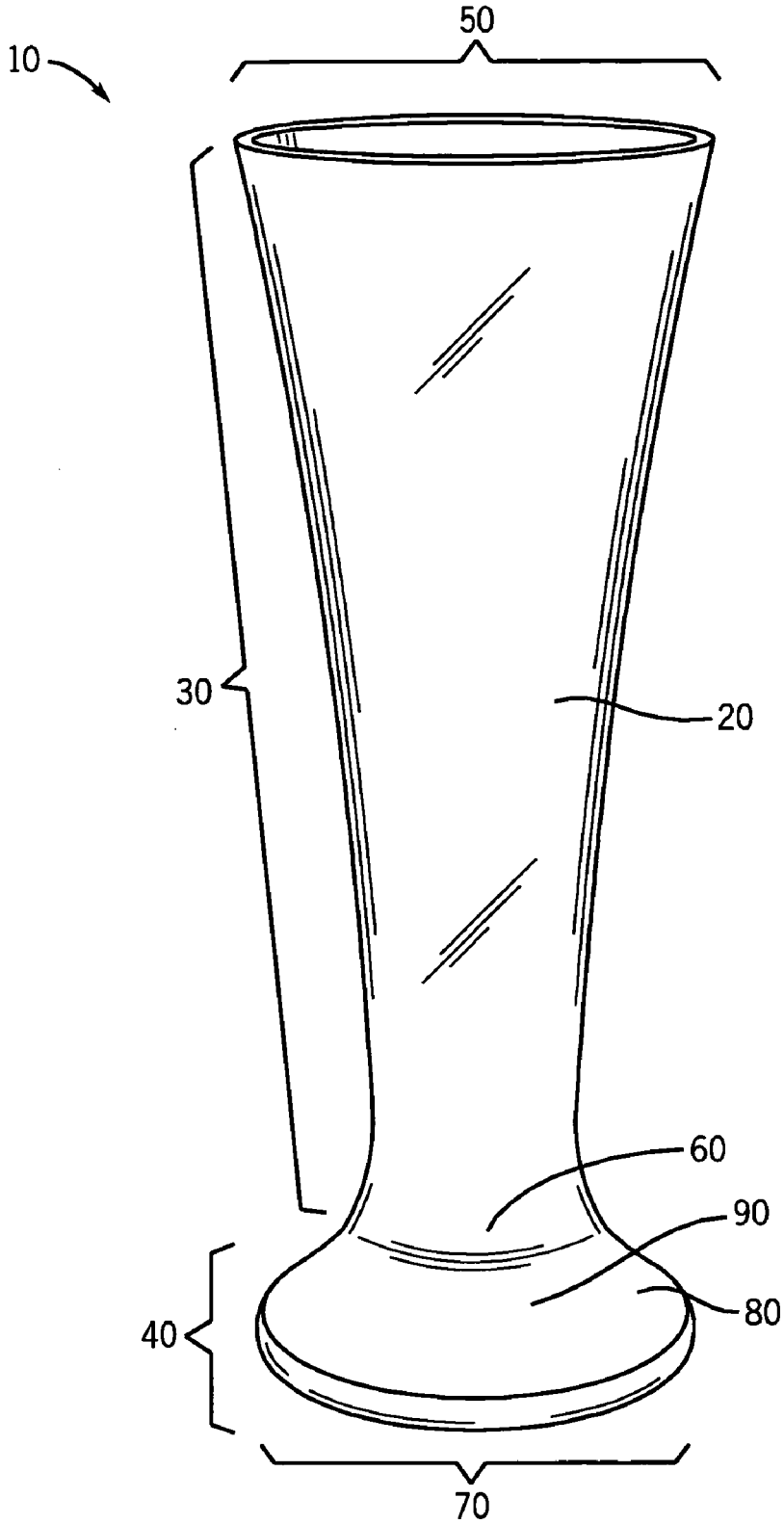
FIG. 1 is a schematic of one embodiment of the cooling vessel.

FIG. 1 shows one embodiment of the vessel, hereafter defined as Vessel 10. Vessel 10 can be made of material known in the art, including but not limited to glass material, metal, plastic, any other material, or any combination thereof. Vessel 10 is capable of being used for holding, pouring, serving, drinking or otherwise delivering a Beverage 20. Vessel 10 has an Upper Portion 30 and a Freezable Portion 40.

The Upper Portion 30 is capable of containing a consumable Beverage 20. The Beverage 20 may consist of any beverage including but not limited to beer, lager, wine, soft drinks, lemonade, punch, flavored beverages, or any other alcoholic or non-alcoholic beverages or combinations thereof. The Upper Portion 30 can be of any shape or size.

Vessel 10 has an Opening 50, in the Upper Portion 30 for delivering the Beverage 20 for serving or consumption. The Vessel 10 also contains a Neck 60, located between the Upper Portion 30 and the Freezable Portion 40. In various other embodiments, it is envisioned that the Upper Portion 30 may also contain any other features in the art, including but not limited to a cap, lid, handle, stem, or various other accompaniments or combinations thereof.

The Freezable Portion 40 contains a Bottom Surface 70 and a Reservoir 80. The Bottom Surface 70 is capable of supporting the vessel in a substantially upright position. The Reservoir 80 is capable of holding a Consumable Substance 90. The Consumable Substance 90 is capable of being frozen in the Freezable Portion 40. The Consumable Substance 90 is capable of cooling the Beverage 20.

The Consumable Substance 90 is placed into the Reservoir 80 prior to freezing. The entire Freezable Portion 40 (including the Reservoir 80) is then placed into an environment, such as a freezer, with a temperature known in the art to accomplish the freezing of the Consumable Substance 90, preferably below the phase transition temperature of the Consumable Substance 90. The Freezable Portion 40 is kept in such an environment until the Consumable Substance 90 is substantially frozen. Preferably, the Freezable Portion 40 is kept in this environment until the outer surface of the Consumable Substance 90 is completely frozen. Most preferably, the Freezable Portion 40 is kept in this environment until the entire Consumable Substance 90 is completely frozen.

After the Consumable Substance 90 is substantially frozen inside the Reservoir 80 of the Freezable Portion 40, the Beverage 20 is then poured or placed through the Opening 50, into the Upper Portion 30 of the Vessel 10. The Consumable Substance 90 then contacts Beverage 20 through the Neck 60. The Beverage 20 is then cooled by its proximity and contact with the substantially frozen Consumable Substance 90.

As the Consumable Substance 90 melts, the Consumable Substance 90 sustains for a period of time a lower temperature than the Beverage 20. Accordingly, the Consumable Substance 90 is capable of continuing to cool the Beverage 20 as the Consumable Substance melts and mixes with the Beverage 20 through the Neck 60.

The inner width of the Neck 60 is smaller in magnitude than the inner width of the Reservoir 80. The preferred ratio of the inner width of the Reservoir 80 to the inner width of the Neck 60 (the "Ratio of the Widths of the Reservoir and the Neck") should be in the range of 1.1 to 10.0. The most preferred Ratio of the Widths of the Reservoir and the Neck is in the range of 1.1 to 5.0.

Subject to the above preferred ranges, the inner widths of the Reservoir 80 and the Neck 60 can be as large or small as reasonably feasible in terms of manufacture, and ease and utility of use. The magnitude of the inner widths of the Reservoir 80 and the Neck 60 may also vary based on the aesthetics of the resulting appearance of the Vessel 10.

The relative widths of the Reservoir 80 and the Neck 60 and may also depend on the nature of the Beverage 20, and of the customer being served. For example, when the Ratio of the Widths of the Reservoir and the Neck is relatively small (e.g. as this ratio approaches 1.1, in the lower end of the preferred range), the Consumable Substance 90 is in greater communication with the Beverage 20, cooling the Beverage 20 more rapidly and thoroughly. This is ideal for a Beverage 20 which is meant to be consumed more quickly (such as a soft drink or performance drink), and/or for a customer who is very thirsty or in a hurry, or who otherwise prefers to consume the Beverage 20 more quickly.

On the other hand, when the Ratio of the Widths of the Reservoir and the Neck is relatively large (e.g. as this ratio approaches 10.0, in the upper end of the preferred range), the Consumable Substance 90 remains in the Reservoir 80 for a longer duration, and thus will cool the Beverage 20 over a longer period of time. This is ideal for a Beverage 20 which is meant to be consumed more slowly (such as wine or champagne), and/or for a customer who prefers to savor the Beverage 20 and/or consume the Beverage 20 more slowly.

By way of example only, the example in FIG. 1 contains a Ratio of the Widths of the Reservoir and the Neck of approximately 2.6.

In some embodiments of the vessel, the Consumable Substance 90 is the same type of substance as the Beverage 20. This allows for the Beverage 20 to maintain a consistent, undiluted taste as the Consumable Substance 90 approaches the phase transition temperature and gradually melts and mixes with the Beverage 20 without floating to the top.

In some embodiments of the vessel, the Consumable Substance 90 is a flavoring capable of complementing or enhancing the taste of the Beverage 20 as the Consumable Substance 90 approaches the phase transition temperature and gradually melts and mixes with the Beverage 20. The flavoring incorporated in the Consumable Substance 90 in such embodiments may include, without limitation, any kind of fruit including but not limited to strawberry, lemon, lime, orange, raspberry, mango, or any other fruit or fruit flavorings or combinations thereof, or garnishments, or any other flavorings, or any combinations thereof.

In some embodiments of the vessel, as in FIG. 1, the Upper Portion 30 and the Freezable Portion 40 of the vessel are permanently attached to one another. In other embodiments, it is envisioned that the Upper Portion 30 and the Freezable Portion 40 of the vessel may be separable, to allow the Freezable Portion 40 to be frozen separately from the Upper Portion 30. For example, the Upper Portion 30 and the Freezable Portion 40 may be separable and capable of being physically coupled with one another by one or more of a variety of means, including but not limited to by fastening, snapping, twisting, clamping, screwing or latching, or any other methods or combinations thereof.

Figure 2:
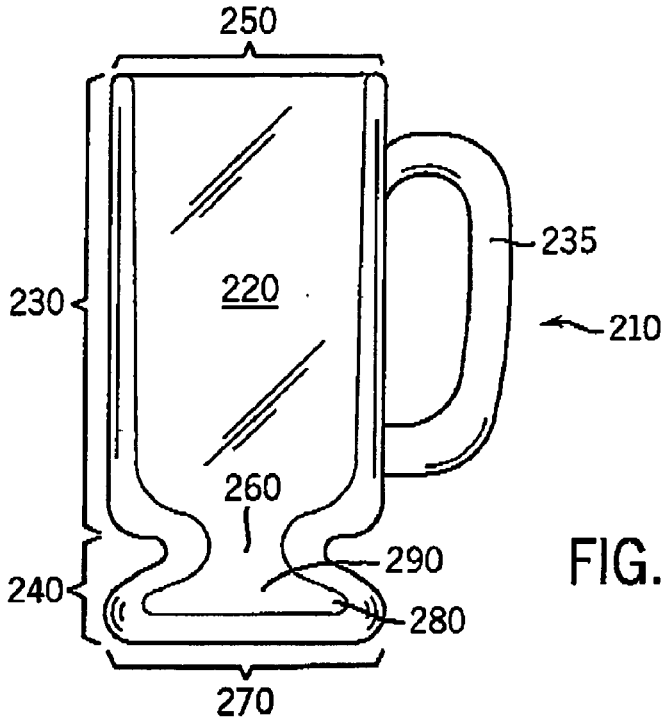
FIG. 2 is a cross-sectional view of an alternate embodiment of the vessel.

FIG. 2 FIG. shows another embodiment of the vessel, hereafter defined as Vessel 210. Vessel 210 is a pitcher capable of being used for holding, serving, pouring, drinking or otherwise delivering a Beverage 220. Vessel 210 can be made of material known in the art, including but not limited to glass material, metal, plastic, any other material, or any combination thereof.

Similar to Vessel 10 from FIG. 1, Vessel 210 contains an Upper Portion 230 capable of containing a Beverage 220, an Opening 250, a Neck 260, a Freezable Portion 240, a Bottom Surface 270 and a Reservoir 280 capable of holding a Consumable Substance 290. The example in FIG. 2 also contains a Ratio of the Widths of the Reservoir and the Neck of approximately 2.6.

The Vessel 210 also contains a Handle 235 which is capable of being utilized for lifting, carrying, transporting or otherwise using the Vessel 210, and for example and without limitation, for filling the Vessel 210 with the Beverage 220 or for serving, pouring or drinking the Beverage 220. In various other embodiments, it is envisioned that the Upper Portion 230 may also contain a cap, lid, stem, multiple handles, or various other accompaniments or combinations thereof.

In FIG. 2, the Upper Portion 230 and the Freezable Portion 240 of the vessel are permanently attached to one another. In other embodiments, it is envisioned that the Upper Portion 230 and the Freezable Portion 240 of the vessel may be separable, to allow the Freezable Portion 240 to be frozen separately from the Upper Portion 230. For example, the Upper Portion 230 and the Freezable Portion 240 may be separable and capable of being physically coupled with one another by one or more of a variety of means, including but not limited to fastening, snapping, twisting, clamping, screwing or latching, or any other methods or combinations thereof.

Figure 3:
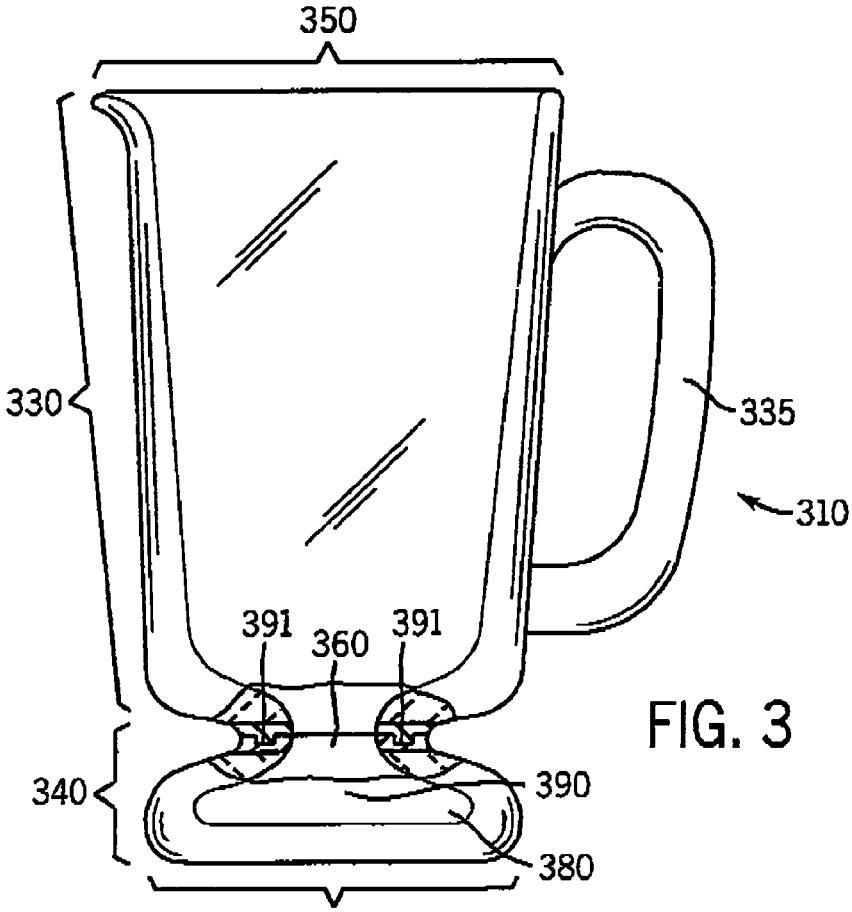
FIG. 3 is cross-sectional view of another alternate embodiment of the vessel.

FIG. 3 shows another embodiment of the vessel, hereafter defined as Vessel 310. Vessel 310 is a mug capable of being used for holding, serving, pouring, drinking or otherwise delivering a Beverage 320. Vessel 310 can be made of material known in the art, including but not limited to glass material, metal, plastic, any other material, or any combination thereof.

Similar to Vessel 210 from FIG. 2, Vessel 310 contains an Upper Portion 330 capable of containing a Beverage 320, an Opening 390, a Neck 360, a Freezable Portion 340, a Bottom Surface 370, a Reservoir 380 capable of holding a Consumable Substance 390, and a Handle 335. In various other embodiments, it is envisioned that the Upper Portion 330 may also contain a cap, lid, stem, multiple handles, or various other accompaniments or combinations thereof. The example in FIG. 3 contains a Ratio of the Widths of the Reservoir and the Neck of approximately 3.1.

In some embodiments of the vessel, the Upper Portion 330 and the Freezable Portion 340 of the vessel are permanently attached to one another. In other embodiments, it is envisioned that the Upper Portion 330 and the Freezable Portion 340 of the vessel may be separable, to allow the Freezable Portion 340 to be frozen separately from the Upper Portion 330. For example, the Upper Portion 330 and the Freezable Portion 340 may be separable and capable of being physically coupled with one another by one or more of a variety of means, including but not limited to by use of snaps 391 (depicted in FIG. 3), or by fastening, twisting, clamping, screwing or latching, or any other methods or combinations thereof.

Although the invention has been described in detail with reference to the presently preferred embodiments, those of ordinary skill in the art will appreciate that various modifications can be made without departing from the invention. Accordingly, the invention is defined only by the following claims.

I claim:

1. A vessel for cooling a beverage, comprising:

a freezable portion comprising a reservoir, wherein:

the reservoir has a bottom capable of supporting the freezable portion or the entire vessel in a substantially upright position;

the reservoir has an inner width at its widest point; and the reservoir is so dimensioned as to be capable of holding a consumable substance, wherein the consumable substance is capable of being frozen in the freezable portion and wherein the consumable substance is capable of cooling a beverage;

an upper portion, capable of being coupled to the freezable portion, comprising:

an opening, wherein the opening is capable of allowing the beverage to be served, poured or consumed; and a neck located between the upper portion and the freezable portion, wherein the neck has an inner width at its narrowest point, and wherein the width of the neck is less than the inner width of the reservoir of the freezable portion.

2. The vessel of claim 1, wherein the upper portion comprises a mug for serving, pouring or drinking a beverage.

3. The vessel of claim 1, wherein the upper portion comprises a cup or glass for serving, pouring or drinking a beverage.

4. The vessel of claim 1, wherein the upper portion comprises a pitcher for serving, pouring or drinking a beverage.

5. The vessel of claim 1, wherein the upper portion is selected from: a bowl, bottle or can for serving, pouring or drinking a beverage.

6. The vessel of claim 1, wherein the upper portion contains a handle.

7. The vessel of claim 1, wherein the upper portion contains at least one handle, lid, cap, stem or other functional or aesthetic accompaniments, or any combinations thereof.

8. The vessel of claim 1, wherein the freezable portion and upper portion comprise a single unit.

9. The vessel of claim 1, wherein the freezable portion and upper portion comprise separable parts capable of being physically coupled together after the consumable substance in the freezable portion is substantially frozen.

10. The vessel of claim 9, wherein the freezable portion is capable of being fastened to the upper portion after the consumable substance in the freezable portion is substantially frozen.

11. The vessel of claim 9, wherein the freezable portion is capable of being coupled with the upper portion by twisting after the consumable substance in the freezable portion is substantially frozen.

12. The vessel of claim 9, wherein the upper portion is capable of being snapped onto the freezable portion after the consumable substance in the freezable portion is substantially frozen.

13. The vessel of claim 9, wherein the method of coupling of the freezable portion and upper portion is selected from: clamping, screwing or latching after the consumable substance in the freezable portion is substantially frozen.

14. A freezable container comprising a reservoir, wherein:

the reservoir has a bottom capable of supporting the container in a substantially upright position;

the reservoir is capable of holding a consumable substance, wherein the consumable substance is capable of being frozen in the freezable portion and wherein the consumable substance is capable of cooling a beverage;

the reservoir has an inner width at its widest point;

the reservoir contains an opening, wherein the opening has an inner width at its narrowest point;

the inner width of the opening is less than the inner width of the reservoir; and the reservoir container is capable of being coupled with a second container containing a beverage, wherein:

the reservoir container is positionable beneath the second container;

there is a neck separating the consumable substance in the reservoir container from the beverage in the second container above it; and the inner width of the neck is less than the inner width of the reservoir.

15. A method of manufacture, comprising:

(a) providing a mold for a vessel for cooling a beverage, the vessel, comprising:

a freezable portion comprising a reservoir, wherein:

the reservoir having a bottom capable of supporting the freezable portion or the entire vessel in a substantially upright position; and the reservoir is capable of holding a consumable substance, wherein the consumable substance is capable of being frozen in the freezable portion and wherein the consumable substance is capable of cooling a beverage, an upper portion, capable of being coupled to the freezable portion, comprising:

an opening, wherein the opening is so dimensional as to allow the beverage to be served, poured or consumed; and a neck located between the upper portion and the freezable portion, wherein the inner width of the neck is less than the inner width of the reservoir of the freezable portion;

(b) filling the mold with liquid capable of hardening;

(c) allowing the liquid to substantially harden inside the mold; and (d) removing the substantially hardened liquid from the mold.

16. The method of manufacture of claim 15, wherein step (b) comprises filling the mold with liquid plastic.

17. The method of manufacture of claim 15, wherein step (b) comprises filling the mold with molten glass.

18. The method of manufacture of claim 15, wherein step (b) comprises filling the mold with liquid metal.

19. The method of manufacture of claim 15, wherein step (a) comprises providing a mold in the shape of the container in claim 1.

20. The method of manufacture of claim 15, wherein step (a) comprises providing a mold in the shape of the container in claim 14.

21. The method of manufacture of claim 15, wherein step (a) comprises providing a mold in the shape of the container in claim 14.

22. The method of manufacture of claim 15, wherein step (a) comprises providing a mold in the shape of the container in claim 14.

* * * * *